US005105456A

United States Patent [19]

Rand et al.

[11] Patent Number: 5,105,456

[45] Date of Patent: Apr. 14, 1992

[54] HIGH DUTY-CYCLE X-RAY TUBE

[75] Inventors: Roy E. Rand, Santa Clara County; Douglas P. Boyd, San Mateo County; Kristian R. Peschmann, San Francisco County, all of Calif.

[73] Assignee: Imatron, Inc., South San Francisco, Calif.

[21] Appl. No.: 649,614

[22] Filed: Feb. 1, 1991

Related U.S. Application Data

[63] Continuation-in-part of Ser. No. 275,780, Nov. 23, 1988, Pat. No. 4,993,055.

[51] Int. Cl.[5] ..... H01J 35/10

[52] U.S. Cl. ..... 378/125; 378/137; 378/138

[58] Field of Search ..... 378/125, 137, 135, 138

[56] References Cited

U.S. PATENT DOCUMENTS

| | | | |
|---|---|---|---|
| 2,209,963 | 8/1940 | DuMond | 378/137 |
| 2,493,606 | 1/1950 | Waterton | 378/125 |
| 4,788,705 | 11/1988 | Anderson | 378/125 |

*Primary Examiner*—Craig E. Church

*Attorney, Agent, or Firm*—Flehr, Hohbach, Test, Albritton & Herbert

[57] ABSTRACT

A rotating x-ray tube includes an electron-beam accelerator assembly having an indirectly heated cathode structure. The cathode structure includes an electron-emitting region mounted at the center of a rotationally symmetric Pierce-cathode configuration. An electron beam travels along a selected path as the tube rotates so that the electron beam strikes selected portions of a target mounted within the tube as it rotates. Two magnetic coils and a ferromagnetic mirror plate are arranged to function as a single quadrupole electromagnet, which has its axis parallel to and offset from the electron beam and which elongates the electron beam in a radial direction.

9 Claims, 12 Drawing Sheets

DELTA MAGNET-IDEAL POLE CONFIGURATION

DELTA MAGNET-COIL CONFIGURATION

HIGH DUTY-CYCLE X-RAY TUBE

CROSS REFERENCE TO RELATED APPLICATIONS

This is a continuation-in-part of a U.S. Pat. application Ser. No. 275,780, filed Nov. 23, 1988 now U.S. Pat. No. 4,993,055 by Roy E. Rand et al., and entitled "Rotating X-Ray Tube with External Bearings."

BACKGROUND OF THE INVENTION

1. Field of the Invention

This invention relates to rotating x-ray tubes and more particularly, to high-power, rotating x-ray tubes having improved cathode structures and improved electron-beam deflection systems.

2. Prior Art

X-ray tubes have applications in two fields: medical x-ray diagnostic imaging and industrial x-ray imaging. Medical imaging x-ray tubes are characterized as providing x-rays with high focal spot brightness, or energy per unit area, and a low duty-cycle. Industrial x-ray tubes, which are used, for example, for non-destructive testing (NDT) are characterized as providing x-rays with lower brightness but with high duty-cycles. Medical x-ray tubes often use a rotating target anode enclosed within a vacuum envelope to achieve high peak brightness. The rotating anode is often a disk which is cooled by high-temperature radiation cooling. This radiation cooling must dissipate the heat energy produced, which is typically in the range of 3 kilowatts. Failure to dissipate this heat results in a temperature rise which can irreversibly damage or destroy components of these expensive tubes. The efficiency of radiation cooling dramatically increases at higher temperatures so that efficient radiation cooling requires operation of the anode at high temperatures, which increases the conditions for and the likelihood of tube damage or failure. In contrast, industrial x-ray tubes use a fixed target anode which is being cooled by direct contact with a cooling fluid, permitting high duty-cycles, typically below 3 kilowatts.

Medical x-ray tubes are used in computerized-tomography (CT) imaging systems as a source of high focal spot brightness to form images which are analyzed to precisely differentiate between various tissue structures. However, CT imaging systems, or scanners, have severe operational limitations imposed upon them due to the limited duty-cycles of the rotating anode x-ray tubes used in such CT imaging systems. In operation, because commercial x-ray tubes used in CT systems have very low duty-cycles, these CT systems must be used intermittently in order to allow the x-ray tube to cool. For example, a typical abdominal scan requires 20,000 watts of electron beam power. Yet, the maximum power dissipation, or cooling rate, of a typical rotating-anode x-ray tube is in the range of 1,000 watts, with 3,000 watts power dissipation being available for certain tubes employing an oil-recirculating heat-exchanger. This results in a theoretical maximum duty cycle of 0.05 to 0.15. If, however, a tube is operated at such maximum duty cycle; that is, at its peak anode heat dissipation, tube life is drastically reduced to, e.g., a few hours. So the practical duty cycle is significantly below the quoted theoretical range.

One component which is particularly subject to damage and failure is the bearing supporting the rotating anode within an x-ray tube in a vacuum. Typically, the anode disk is mounted at the end of a rotatable structure supported by the bearing. The bearing surfaces are contained within the vacuum of the tube. Because a lubricant would contaminate the vacuum enclosure, no lubricants are used. Heat dissipation from a tube during high load conditions is provided primarily by radiation of thermal energy from the rotating anode disk to the walls of the envelope containing the vacuum for the tube. The walls of the envelope are composed of glass, metal, and/or ceramic materials and may be surrounded by a dielectric oil bath. For radiation cooling to be effective, the anode disk must be at an elevated temperature. However, if the anode temperature is elevated for an extended period of time, the bearing gets too hot and its lifetime is dramatically reduced. With the advent of CT, the designs of existing rotating x-ray tubes were challenged. Bearings were redesigned to prevent movement of the focal spot, that is, the region on the anode struck by an electron beam, as components of the tube expanded and contracted as the temperature of the tube changed. CT systems were particularly sensitive to movement of the focal spot on a target anode.

Another challenge to tube designers was to increase the average power of a tube to increase its loadability, that is, a tube's ability to handle a greater average power while keeping its temperature within safe limits. Limitations on loadability to a few hundred watts means that a piece of CT equipment must be kept idle to allow the x-ray tube to cool sufficiently to permit a subsequent series of CT scans, or images, to be made. Over the past years the loadability factor has been incrementally improved. It appears that most tube manufacturers have chosen the same solutions to the problems outlined herein. These solutions have involved increasing the diameter, size, weight, and surface emitting of the rotating anode disk, as well as using heat-exchangers for the oil-dielectric surrounding the vacuum envelope of these tubes. Only incremental progress has been made regarding the bearings contained within the vacuum. One manufacturer has introduced a rotating anode tube with liquid bearings.

Currently, the newest and largest-capacity rotating x-ray tubes being commercially produced use heat exchangers and can dissipate up to 3000 watts. Since continuous input powers of 20–30,000 watts are still desired, these x-ray tubes have a duty-cycle of approximately 10% and still must be kept idle for over 90% of the time. Operating these tubes at a power level of 3000 watts reduces the life of their bearings to a few hours. In addition, these tubes with their associated heat-exchangers are quite bulky and very expensive.

Even though x-ray tube designs have been incrementally improved, it still remains a problem that the type of x-ray tubes needed for CT still need to be idled once they have their thermal capacity loaded up by initial operation of the tube from a cold start. In the operation of a CT system, a certain amount of this type of idle time can be masked partially by whatever time is required to perform digital data processing and image reconstruction. As electronic computer processing systems become faster and less expensive, image reconstruction times become shorter and eventually may be the same as the actual x-ray scanning time. However, in certain situations the x-ray tube is still the limiting factor when higher patient throughput is needed, for example, to improve the economic balance sheet of a facility, or to cope with civil emergency situation, or to handle battlefield triage conditions.

Technical x-ray imaging systems do not use rotating anode tubes. For non-destructive-testing (NDT), rotating anode x-ray tubes are rarely used. These systems use so-called stationary anode tubes, which are rugged tubes normally operated at up to a 100% duty cycle and which have substantial service life. This type of tube has a stationary, liquid-cooled anode. However, their peak power is rated at only approximately 2% of the peak power of a rotating anode tube used in medical imaging systems. Since the focal spot remains stationary on the target anode, the power of a stationary anode tube is limited typically to 300 watts for an effective focus size of 1 by 1 millimeter to 50 watts for a 50 micrometer diameter focus size. For applications requiring high spatial resolution, a small focal spot is required and the tube power must be correspondingly reduced. Because their peak power is low, these tubes have severe limitations with respect to their spatial resolution capabilities and with respect to the maximum thickness of an object to be scanned. Industrial x-ray inspection systems are restricted in their performance by the available x-ray tubes. Medical rotating x-ray tubes are inappropriate for this application, because they are not rugged enough, they are expensive, and they are not available for the higher voltages of ten times required for increased penetration of technical objects. Due to the low x-ray output of industrial tubes, the x-ray detection of an industrial imaging system is practically limited to photographic, silver-emulsion-based recording film. Film is an ideal integrator of an x-ray signal, and can thereby compensate for low x-ray flux with long exposure. As a consequence many industrial inspection exposures last for many minutes, or longer. Digital imaging systems requiring a certain minimum flux of x-rays in order to operate above the electronic noise and electronic stability level cannot be used in spite of their other potential advantages already demonstrated in medical imaging.

A number of improved bearings have been proposed for rotating anode x-ray tubes. Also, rotating x-ray tubes are available which use fluid-cooling of the rotating anode, such as, for example, tubes provided by Elliot of England and Rigaku of Japan. These tubes do combine the strong point of the rotating anode tubes (higher peak power capacity) with the strong points of the fixed anode tubes (direct fluid cooling of the anode). However, these tubes are not used in medical imaging systems because the peak performance of these tubes is not equal to that provided by current rotating anode tubes. In addition, these tubes have another disadvantage which is that they are not hermetically sealed. The rotating shaft for the anode goes through the vacuum envelope via a rotary seal which uses a magnetic fluid with a low vapor pressure. The tube needs to be connected to a vacuum pump to maintain and/or establish a high vacuum within the envelope of the tube. This significantly increases the complexity of an imaging system in addition to increasing reliability and cost.

U.S. Pat. No. 4,621,213 for an "Electron Gun" granted to Roy E. Rand on Nov. 4, 1986 describes an electron gun source of electrons for an x-ray tube.

For high-power, rotating x-ray tubes increased accuracy requires improved cathode structures. For a rotating x-ray tube to replace a stationary tube it is required that a compact beam deflection system be provided so that the rotating x-ray tube has the same form factor.

SUMMARY OF THE INVENTION

It is therefore an object of the invention to provide an x-ray tube which has an improved cathode structure.

It is another object of the invention to provide an x-ray tube which has a compact deflection system.

In accordance with these and other objectives of the invention, an x-ray tube is provided which includes a vacuum envelope in which is mounted a target anode for emitting x-rays. Also within the envelope is an electron gun for projecting an electron beam. The envelope is externally supported for movement. In a preferred embodiment of the invention, that movement is rotary. Means are provided for deflecting the electron beam along a predetermined, fixed path as the envelope rotates. While the envelope along with the target mounted therein is rotating, the electron beam traversing the fixed path strikes various portions of the target anode to distribute the heat load over the target area. In a preferred embodiment of the invention deflection of the electron beam along a fixed path is accomplished by magnetic deflection of the beam along the fixed path. In a particular embodiment of the invention the magnetic deflection is accomplished by use of a dipole magnet which is obtained, for example, by a pair of magnetic coils positioned externally to the envelope to provide a deflection field transverse to the electron beam. Other possible means of deflecting the electron beam are permanent magnets or electrostatic deflectors. Because the target anode is part of the vacuum envelope, the target anode can be rather easily cooled. The target means includes, for example, a tungsten laminate brazed to a TZM base which in turn is attached to form part of the vacuum envelope.

In one embodiment of the invention, an electron-beam accelerator assembly is provided which includes an indirectly heated cathode for emitting an electron beam. The cathode includes an electron emitting region mounted at the center of a rotationally symmetric Pierce-cathode configuration. Means are provided for deflecting the electron beam along a selected path as the envelope rotates such that the electron beam strikes selected portions of the target mounted within the envelope as the envelope rotates. The deflection means includes two magnetic coils and a ferromagnetic mirror plate arranged to function as a single quadrupole electromagnet, which has its axis parallel and offset from the electron beam and which elongates the electron beam in a radial direction.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Reference will now be made in detail to the preferred embodiment of the invention, an example of which is illustrated in the accompanying drawings. While the invention will be described in conjunction with the preferred embodiment, it will be understood that it is not intended to limit the invention to that embodiment. On the contrary, the invention is intended to cover alternatives, modifications and equivalents, which may be included within the spirit and scope of the invention as defined by the appended claims.

Figure 1:
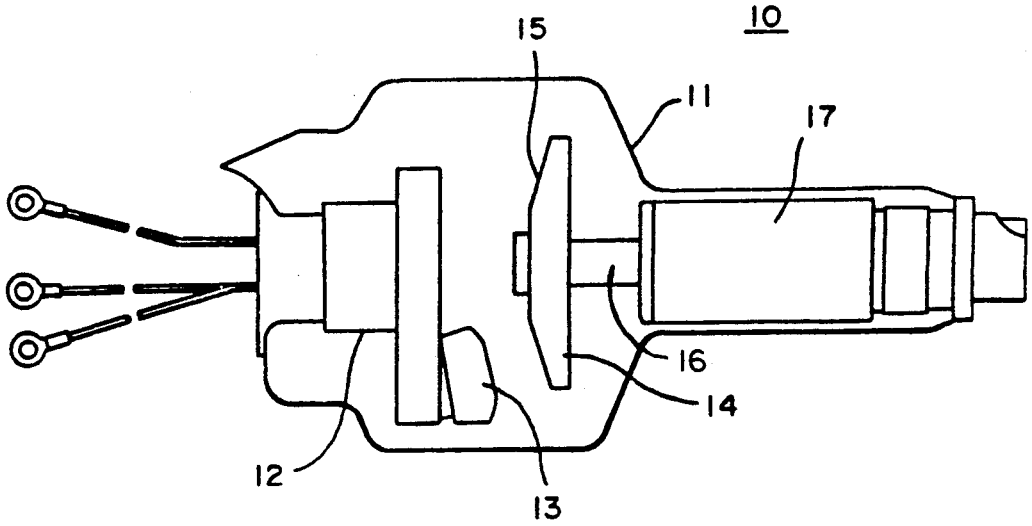
(PRIOR ART) FIG.-1
FIG. 1 shows a prior art rotating anode x-ray tube.

FIG. 1 shows a well-known prior art x-ray tube 10 including a glass vacuum envelope 11 in which is mounted a cathode assembly 12 including an electron source 13. The electron source 13 provides an electron beam to a rotating anode 14, which is shaped as a disk having a slightly beveled target face 15 on which the electron beam strikes to emit x-rays, some of which exit the tube envelope 11 to be utilized externally. The rotating anode disk 14 is mounted at an end of a rod 16 which is rotatably supported within the vacuum by a motor and bearing assembly 17.

Figure 2:
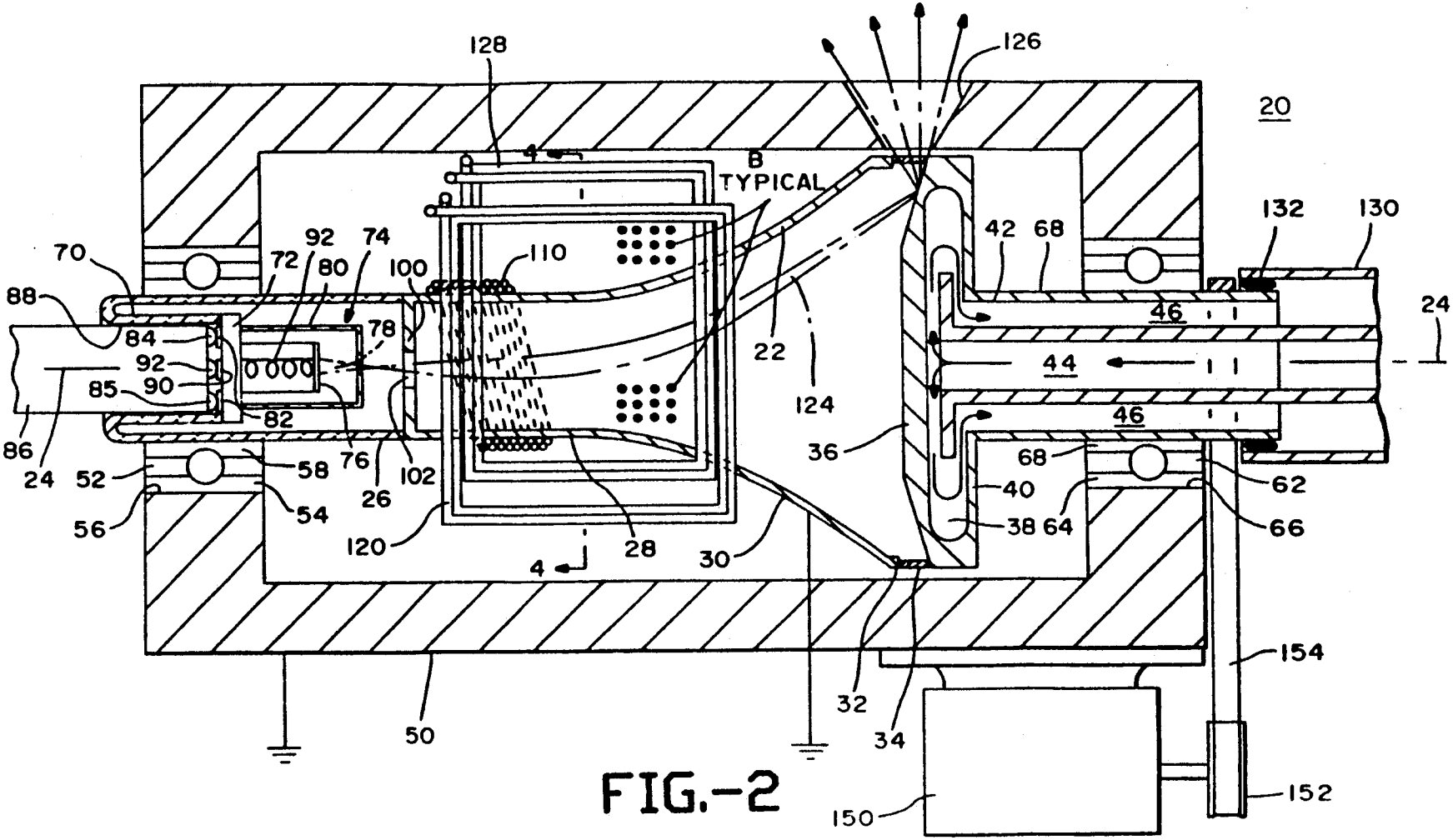
FIG. 2 shows a partially cross-sectional view of an x-ray tube rotatably mounted in a housing with a fixed magnetic field deflecting the electron beam along a fixed path as the x-ray tube rotates relative to the fixed magnetic field according to the invention.

FIG. 2 shows an embodiment of a rotating x-ray tube 20 according to the invention. An evacuated vacuum envelope 22 is provided which in a preferred embodiment of the invention is rotationally symmetrical about an axis 24.

The vacuum envelope 22 includes a hollow cylindrical glass neck portion 26. Attached to one end of the cylindrical portion 26 is a hollow cylindrical metal neck section 28 of a metal bell-shaped anode housing 30. The bell-shaped anode housing 30 is rotationally symmetric and progressively flares out in diameter as one moves away from its cylindrical neck portion 28. The bell-shaped anode is formed, for example, of a suitable material, such as stainless steel. The bell-shaped anode 30 terminates in a cylindrical lip 32 which is fixed to one edge of a cylindrical x-ray window ring 34. The other edge of the x-ray window ring 34 is fixed to a disk-shaped target anode 36. The x-ray window preferably has a substantially constant thickness and is formed from thin stainless steel, or from iron, nickel, and cobalt compositions. Both the bell-shaped anode housing 30 and the target anode 36 are maintained at ground voltage potential. The target anode 36 is formed of a suitable material such as, for example, tungsten or, alternatively, is a composite structure known in the art for emitting x-rays. The target anode 36 has a hollow interior chamber 38 formed therein for passage of a cooling fluid. The external rear wall 40 of the target anode 36 has fixed thereto a hollow cylindrical axially-extending member 42 with two coaxial chambers 44,46 formed therein for passage of said cooling fluid respectively in and out of said hollow interior chamber 38 of said target anode 36.

A support frame 50 supports the vacuum envelope 22 for rotation about the axis 24. One end of the envelope 22 is journaled and supported for rotation by a first ball bearing assembly 52 which has its outer race 54 fixed in an aperture 56 formed in one end of the support frame 50. The inner race 58 of the bearing assembly 52 is fixed to the outer surface 58 of the cylindrical glass neck 26 of the vacuum envelope 30.

The other end of the envelope 22 is journaled and supported for rotation within the support frame by a second ball bearing assembly 62 which has its outer race 64 fixed in another aperture 66 formed in the other end of the support frame 50. The inner race 68 of the bearing assembly 62 is fixed to the outer surface 68 of the cylindrical axially extending member 42.

The glass neck portion 26 at the one end of the evacuated vacuum envelope 22 has fixed to an inner edge of a re-entrant lip portion 70 a plug 72. Mounted on the plug 72 is an electron gun assembly 74 which includes an indirectly heated cathode 76 for generating an electron beam 78. A focusing electrode 80 provides a uniform acceleration field for the electron beam A negative high voltage potential is supplied into the vacuum envelope to the cathode through conductors which pass through the plug 72 to the cathode 76. A slip ring 82 is connected to the conductors and makes sliding contacts with a pair of contacts buttons 84,85 connected to a high-voltage supply cable 86. The end of the cable 86 is journaled within an external cavity 88 formed within the glass neck portion 26 of the vacuum envelope 22 so that a negative high voltage is supplied through the slip ring 82 to the cathode 76 as the envelope 22 rotates within the frame 50. The negative high voltage is supplied, for example, from a fast switching-mode power supply (not shown) which is controlled to rapidly turn the electron beam 78 on or off as required. A center slip-connection pad 90 makes sliding contact with a contact button 92, which is connected through the cable 86 to a filament voltage potential, which floats on the negative high voltage. The pad 90 is connected through the plug 72 to one end of a cathode filament 92 with the other end of the cathode filament being connected to the cathode voltage.

Electrons are drawn from the region near the cathode 76 and accelerated by the electric field created between the cathode 76 and the anode housing 30. The end of the cylindrical metal neck portion 28 which is near the cathode includes an end plate 100 which extends perpendicularly to the axis 24 of the envelope. A central aperture 102 is formed in the end plate 100 to permit the accelerated electron beam to pass through. The electron beam may be focused to a tight waist just before it passes through the end plate aperture 102. A focusing solenoidal coil 110 may be positioned along the axis 24 near the aperture 102 for focusing the electron beam on the target anode 36. Because the metal anode housing 30 is at ground potential, the interior space of the anode housing 30 is field free and the accelerated electrons in the electron beam drift at high velocity toward the target anode 36.

Figure 4:
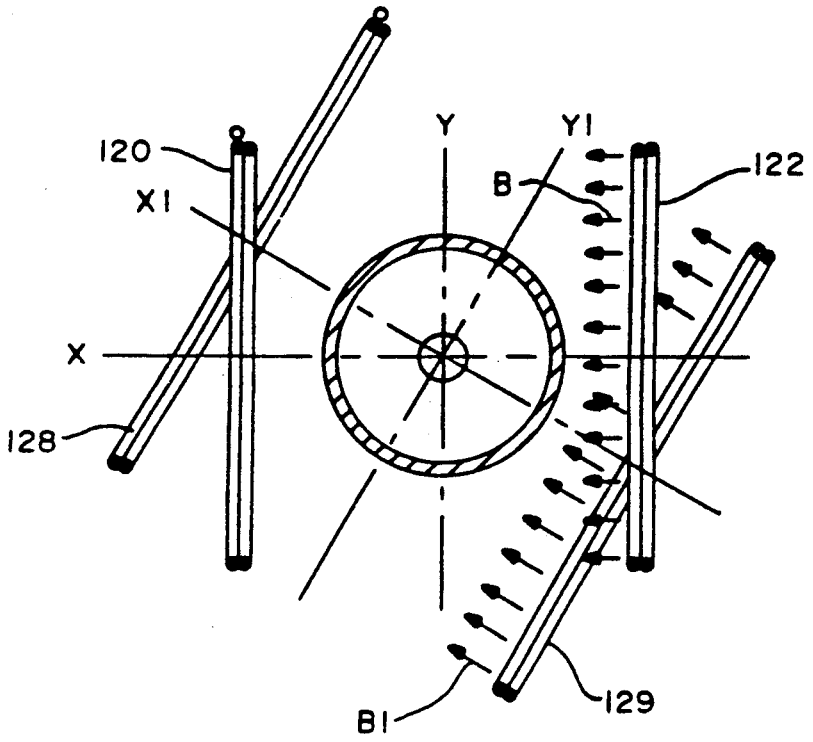
FIG. 4 is a cross-sectional diagram of an x-ray tube according to the invention taken along section line 4—4 of FIG. 2 and showing two pairs of coil windings each providing a dipole magnetic field for deflecting an electron beam along a respective fixed path.

FIGS. 4 and 2 show that a fixed magnetic deflection field B is provided by a pair of deflection coils 120, 122 fixed with respect to the support frame and located respectively on opposite sides of the cylindrical neck portion 28 of the anode housing 30. These coils are connected to constant current sources, not shown, and generate a constant magnetic field B transverse to the axis 24 of the tube. The constant magnetic field B deflects the electron beam so that the electron beam always travels along a fixed path 124 as the x-ray tube envelope rotates about the axis 24. The fixed path 124 can be visualized as being in a vertical plane if the deflection coils 120,122 are thought of as being in vertical planes to produce a B field in a horizontal direction. The deflection coils may also incorporate quadruple coils for shaping the electron beam focal spot on the target anode.

More generally, the magnetic field produced by the deflection coils 120 can be varied to deflect the electron beam along various selected paths, including the fixed path 124, such that the electron beam strikes other selected portions of the target anode. Other techniques are available for deflecting the electron beam along a fixed path including alternative permanent-magnet magnetic deflection means and electrostatic deflection means.

The high-energy electron beam travelling along the fixed path 124 strikes the bevelled surface of the target anode 36 as the tube envelope rotates. X-rays are thereby produced and some of the x-rays exit the tube through the x-ray window 34 and an aperture 126 formed in the frame 50.

An alternate set of deflection coils 128,129 are provided in planes offset from the vertical. These coils are used to generate an alternative constant magnetic field B1, as shown in FIG. 4. The deflection coils 128,129 are in planes which are offset from vertical and produce the B1 field in a direction offset from the horizontal as shown in FIG. 4. Therefore, the path for an electron beam travelling through the B1 field will be in a plane which is at an angle to the vertical.

Figure 3:
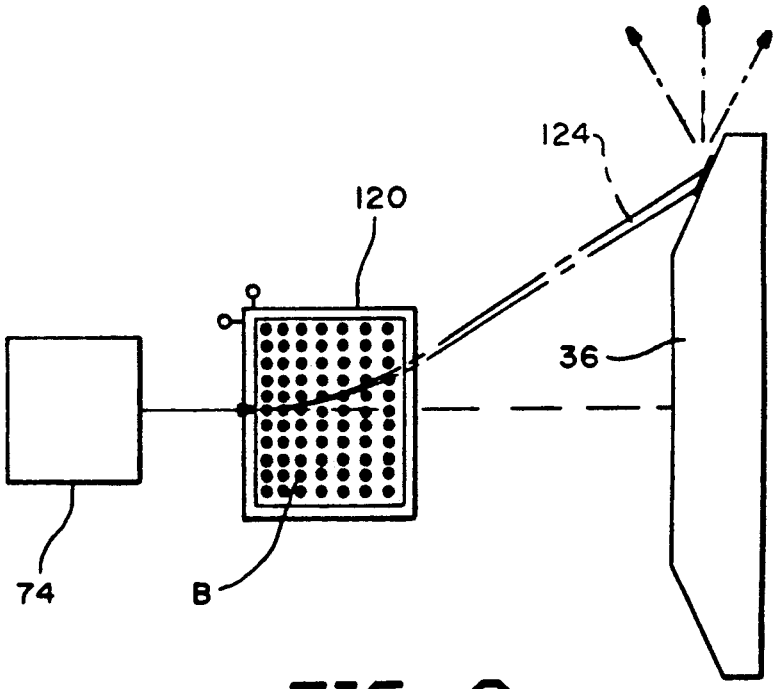
FIG. 3 is a schematic diagram of the principal components of an x-ray generator according to the invention.

FIG. 3 schematically shows an electron gun 74 projecting an electron beam toward a target anode 36. The electron beam is deflected along a fixed path 124 by a transverse magnetic field B deflection means produced by a pair of deflection coils as indicated by one of the coils 120. FIG. 2 indicates that heat generated by the electron beam striking the target anode 36 is removed by a cooling fluid such as water, oil, or a gas, which is directed through the chamber 44 and along the back side of the grounded target anode and out through the chamber 46. The far end of the cylinder 42 is coupled via a rotating seal to a fixed coaxial inlet/outlet conduit 130 for cooling fluid.

Figure 5:
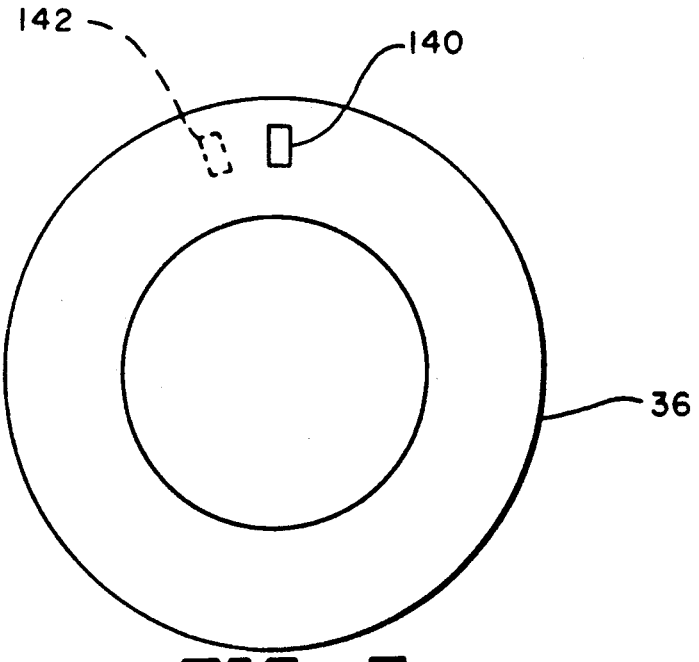
FIG. 5 shows the surface of a target anode.

FIG. 5 shows a face view of the target anode 36. The first focal spot location 140 shows the location of the electron beam as it impinges upon the target when the first set of focusing coils 120,122 are used. When the alternate focusing coils 128,129 are used, the offset focal spot location 142 is produced. This permits the focal spot position to be moved. Applications of the movable focal point permit two separate focal spots or sources of x-radiation to be used, for example, to increase the spatial resolution in a CT scanner.

In operation, the envelope is rotated at an appropriate speed depending on the target anode design and the operational heat load. The envelope 22 is rotated by using a suitable drive motor 150 fixed to the support frame 50. The motor 150 is coupled to the external end of the member 42 with an appropriate coupling means including, for example, a pulley 152 driving a belt 154 or a gear train (not shown). Alternatively, the envelope 22 is rotated by including suitable vanes (not shown), within the fluid chambers of the anode, which vanes are driven by the coolant fluid to rotate the envelope.

Another Embodiment of a Rotating X-ray Tube

FIGS. 6 through 14C illustrate another embodiment of a continuous high power x-ray tube 200, which is similar in many aspects to the previously described x-ray tube. In operation, a belt 202 connected to a motor 204 rotates a vacuum envelope 206 inside a housing 208. An electron beam (not shown) is provided along an axis between a cathode 210 and an anode 212. The beam enters a conical portion 214 of the vacuum envelope 206 and is deflected off axis by an electromagnet structure 216. The electron beam constricts to a primary focus or waist inside the anode 212 and then expands due to internal forces. The beam is deflected and focused onto a rotating target anode 218. X-ray radiation exits through thin window 220 and a radiation exit port 222. The rotating target anode 218 is in contact with coolant from a supply.

This design combines the advantage of stationary-anode x-ray tubes, which is 100 percent duty cycle operation, with the advantages of medical x-ray tubes, which is high brightness, high power-density focus, and high instantaneous power. This type of x-ray tube is hermetically sealed, does not require active vacuum pumping, and has no rotating vacuum feedthroughs.

The x-ray producing target 218 forms a part of the vacuum envelope itself. In operation, the target is fixed to the vacuum envelope and rotates around a symmetry axis within the stationary tube-housing. The target is liquid or gas-cooled through its outside wall. The tube can be driven by (as shown) a single-ended negative high-voltage supply with the anode at ground potential. It can also be designed for a bipolar power supply, such as typically used in conventional medical tubes.

The thermionic cathode 210 is placed on the axis of rotation. Feedthroughs connect the high voltage and the cathode heater current into the tube. The electrical connections are passed through a small-diameter slip ring 224, which is located at the cathode end of the tube. The tube generates an intense beam of electrons, which impinge on the target 218.

The rotating tube-envelope is mounted in a stationary frame, or tube housing 208. This frame holds, among other things, one main bearing 226, a deflection magnet assembly 216, and various electrical connections. The stationary magnet 216 surrounds the tube 206 and provides a constant magnetic field. Using this field, the high power electron beam is (i) deflected, and (ii) focused off-axis onto the target. A second bearing 226 is integrated with the cooling system and is mounted to the housing 208. The housing is divided into two sections near the main bearing 226, which is a sealed bearing.

A high voltage receptacle 228, the slip ring 224, and the high voltage section of the tube are surrounded by transformer oil in a chamber 230. Oil insulation is not necessary for the remaining portion of the tube and the bearings provide a rotating seal for containment of the oil.

This design eliminates three major problems of existing medical x-ray tubes: (1) The bearings have been taken out of a high temperature/high vacuum environment. Failure of vacuum-mounted bearings is the main reason for the breakdown of conventional tubes at high or even moderate duty cycles. (2) The target, which is the heat-generating element of the tube, is not suspended in a vacuum but is fully accessible for direct cooling. The high operating temperature of the target in conventional tubes is the reason for limited tube life and for requiring derating of a tube's x-ray output intensity. (3) The cantilevered target mounting has been obviated by making the target an integral part of the tube envelope. Shock and vibrational sensitivity of a cantilevered, heavy piece of tungsten/molybdenum for the target is also avoided.

When comparing the design goals of the present x-ray tube with the existing medical x-ray tubes the following differences and similarities are apparent:

| Component | Conventional Tube | Present X-ray Tube |
|---|---|---|
| anode | sintered/forged, can be graphite-backed | same construction or from rolled sheet, no backing required. |
| | radiatively-cooled, at high potential | contact-cooled at ground potential (at high potential possible) |
| cathode | directly heated tungsten at high potential | dispenser type at high potential |
| bearing | special, for temperatures up to 850° F.+ high vacuum compatible | for room temperature no vacuum-compatibility required |
| rotation | highly special motor: magnetic drive through envelope, 300 watt | standard motor 50 watt |
| magnetic coils | not required | constant-current coils (or permanent magnet) |
| magnetic shielding | not required | mu-metal shielding |
| vacuum technology | sophisticated | sophisticated |
| heat-exchanger | oil or water | water or oil or air |
| continuous dissipation | up to 3 kW | up to 30 kW (this power is equivalent to flow-through home-appliance water heater) |
| switched/scanned focus-position | special tubes, not on the market | built-in capability |

Tube Envelope Design

Figure 6:
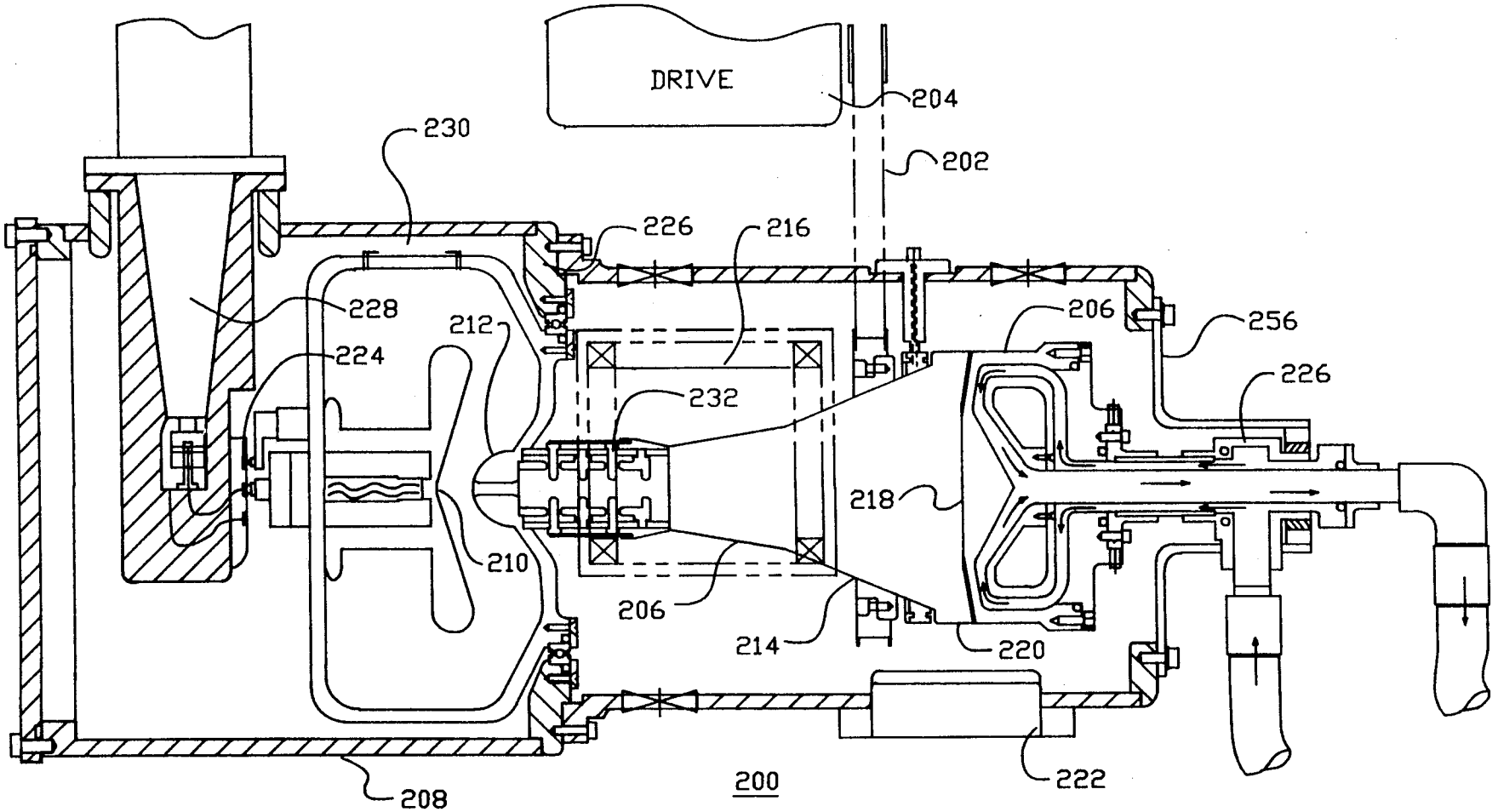
FIG. 6 is a partially sectional view of another embodiment of a continuous high power x-ray tube.

FIG. 6 shows the tube 214 assembled in the tube housing 208. The tube itself (or "insert") consists of a vacuum container or vacuum envelope, and various subcomponents mounted on the inner (vacuum) side of the wall, and on the outer wall. The envelope provides support for the electron gun components, that is a cathode, heater, and Pierce electrode. The x-ray tube also includes the tubular anode 212. The shape of the anode determines the field distribution required for forming a pencil beam of electrons. The anode 212 has an axial bore through its center to permit the electron beam to pass through.

Included within the tube envelope are ion clearing electrodes (or ICE-electrodes) 232. These electrodes are formed by 8 alternating layers of electrodes and ceramic, brazed together. An electron beam passes through a region with a spatially alternating electric field provided by this series of electrodes. This field sweeps the electron beam clear of positively-charged residual gas ions, which otherwise would neutralize the space charge of the beam and cause the beam to collapse.

We have calculated that at $10^{-8}$ Torr residual gas pressure the electron beam neutralizes through the generation of positive ions within 37 ms (milliseconds). The ion extraction time should be at least 100 times smaller than this, which leads to the required potential of 500 volt at the ICE electrodes.

The wall thickness of the relatively flat metal sections of the envelope is 4 to 5 mm, the conical part around 1.5 mm of stainless steel, and the cylindrical x-ray exit window just in front of the target anode is, with a thickness of 0.5 mm (about 0.020"), the thinnest part of the envelope. This 0.020 inch thick steel sleeve is brazed to a machined groove at the tungsten side of the anode target. This sleeve is part of the wall of the vacuum tube envelope and it also is the radiation exit window. It has to have very good uniformity to avoid excessive modulation of radiation output.

Cathode Slip Ring Design

Figure 7:
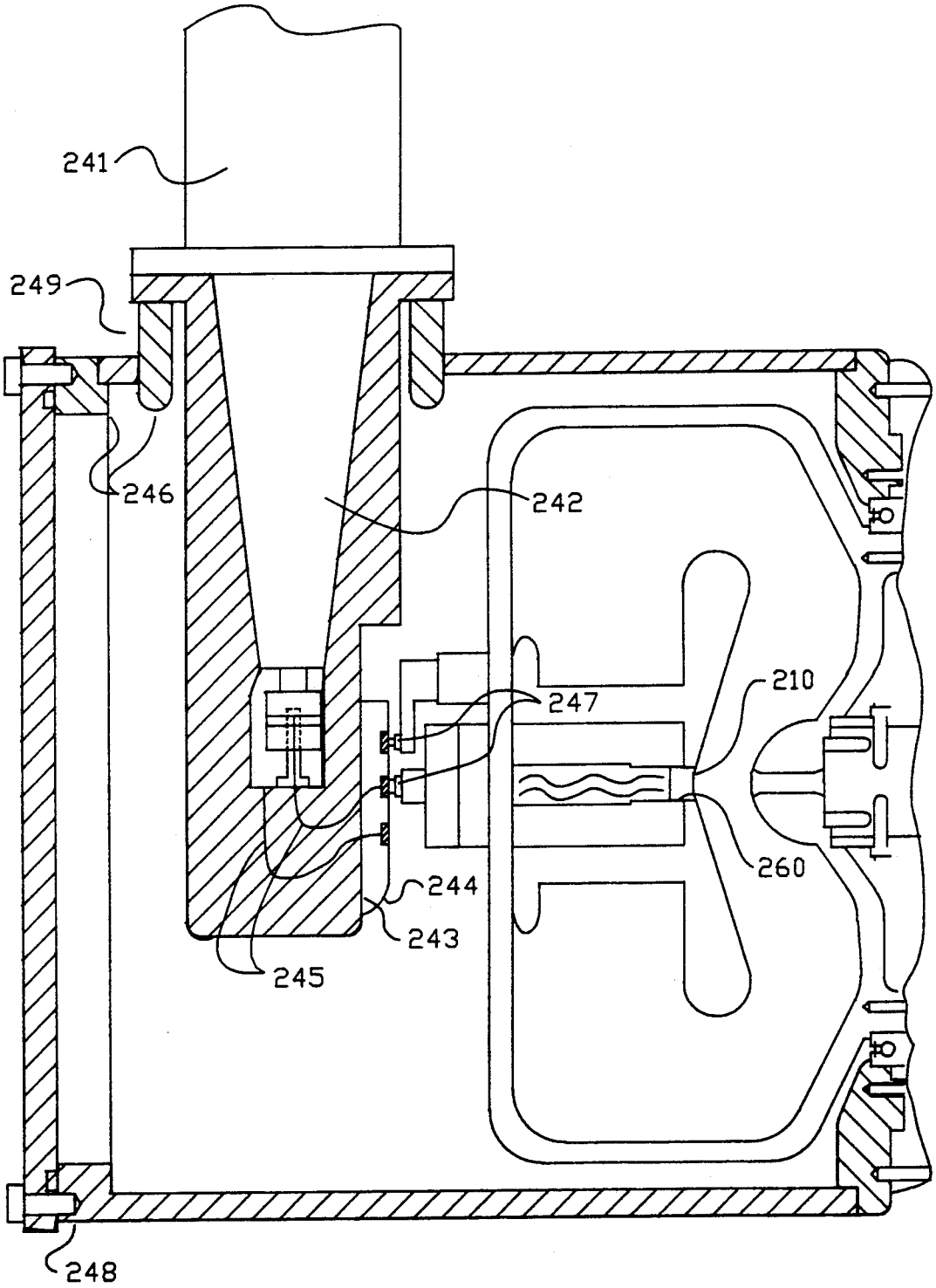
FIG. 7 is an enlarged detailed view of the cathode end of the x-ray tube of FIG. 6.

FIG. 7 illustrates features of a high voltage receptacle and cathode connections, including a standard high voltage connector 241; a high voltage well 242; a flat mounting surface 243 for a cathode slip ring; assembly 244 with one center pad and one contact ring; a rounded corner 244 for insertion past the contact pins (brushes); an electrical connection 245; various rounded corners 246 for corona discharge suppression; slip ring brushes 247; a housing flange 248; and a receptacle flange 249.

Tungsten/Anode Modification

Figure 8:
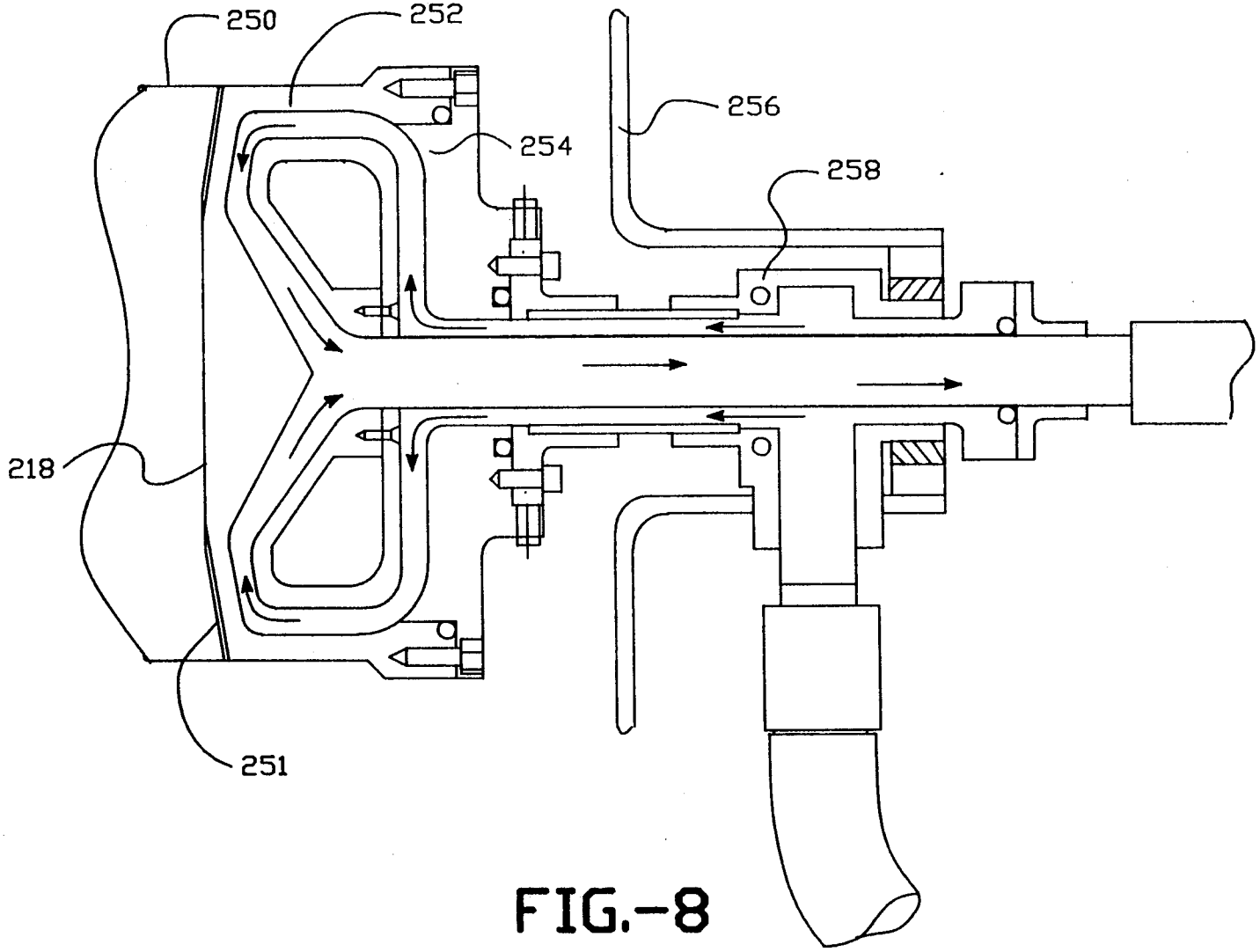
FIG. 8 is an enlarged detailed view of the target end of an x-ray tube of FIG. 6.

FIG. 8 illustrates the liquid-cooled rotating target 218 which includes a modified, forged rotating anode of tungsten alloy mounted on a molybdenum alloy, which is mounted on a coolant delivery manifold. A 0.020" steel sleeve 250 is brazed to a machined groove at the tungsten side of the target disc 251. This sleeve is part of the wall of the vacuum tube envelope and at the same time the radiation exit window. A flange 252 is brazed to the back of the target disc 251 to form a cooling channel. It leaves access for the stationary coolant delivery system. A coolant chamber is closed by a lid 254 and flange 256 (FIG. 6), which terminates at an elastomer seal 258.

Target anodes suited for the generation of high brightness x-ray foci have been developed in a small number of laboratories throughout the world. A material, which is uniquely suited for this application is tungsten. Tungsten is relatively abundant, has refractory properties, in particular a very high melting point and low vapor pressure (e.g., used for incandescent lamp filaments), and it very high density and atomic number which results in a comparatively good (high) conversion rate of fast electrons into emitted x-radiation.

The mechanical and machining properties of tungsten are very interesting and most of the manufacturing processes involving tungsten are based on powder metallurgy. The extreme refractory properties of pure tungsten can be mollified by adding a small percentage of the relatively rare element rhenium. It is the refined tungsten-rhenium powder metallurgy which has resulted in the optimized performance, realized in today's medical x-ray tubes.

The present design can take full advantage of this already developed technology. Forged x-ray anode disks are commercially available and tungsten-rhenium alloy forming and brazing technology has been developed by the one of the present inventors.

Calculations of the Prototype Electron Beam Optics

In the tube, a high power beam of electrons is transported over a distance of 20 cm (8 inches), from thermal cathode to target anode. In conventional tubes this distance is about one cm. Hence, it is this beam transport which sets the present x-ray tube apart from the other tubes. The preferred electron source includes a cathode, two focusing electrodes—Pierce electrode at cathode potential and a shaped anode with center bore—and a stationary magnet to generate a suitable field for focusing and deflection of the beam.

In contrast to conventional rotating x-ray tubes which employ a proximity-focused electron beam, the present tube is based on an "electron gun" as the source of an electron beam. The beam goes through a primary focus or rather a "beam waist," generated in the tubular anode 212. The beam control fields then generate a secondary and x-ray emitting focus on the target-anode.

Base Parameters

For the overall layout of the tube the dimensions of the electron gun are quite essential. They depend to some degree on the basic performance data of the finished tube, like high voltage and current. As a first step to the design of the electron beam accelerator part of the tube we generate the following set of tube base parameters:

Acceleration voltage: 130,000
Current: 50 mA
Target-anode radius: 5 cm
Angle of electron beam deflection: 20–25 degrees
Distance from deflection-magnet center to anode: 11 cm
Magnet effective length 8 cm
Image distance: $\approx 7$ cm
Object distance: range 5–20 cm, depending on required spot size.

These parameters do not at all represent limitations for the present invention, they are rather convenient base parameters for a prototype test tube. But on the other hand, no existing medical tube could be operated under these (prototype) conditions for longer than a few seconds.

Cathode/Focusing Cup/Tubular Anode Parameters

Figure 9:
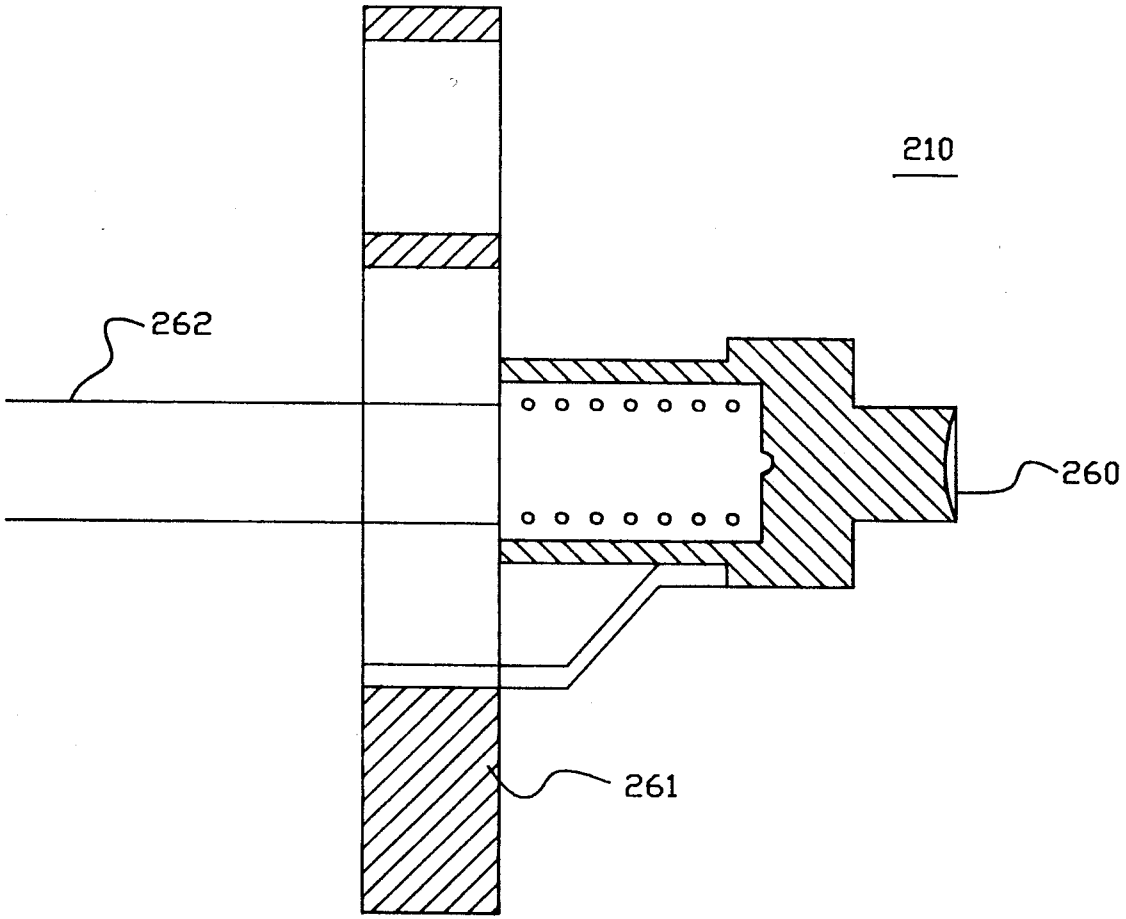
FIG. 9 shows a detailed view of the emitter head for the embodiment of FIG. 6.

FIG. 9 shows cathode 210 design with a small emitter head 260 positioned to be heated by a bifilar heater filament 262 and supported on a ring 261.

Figure 10:
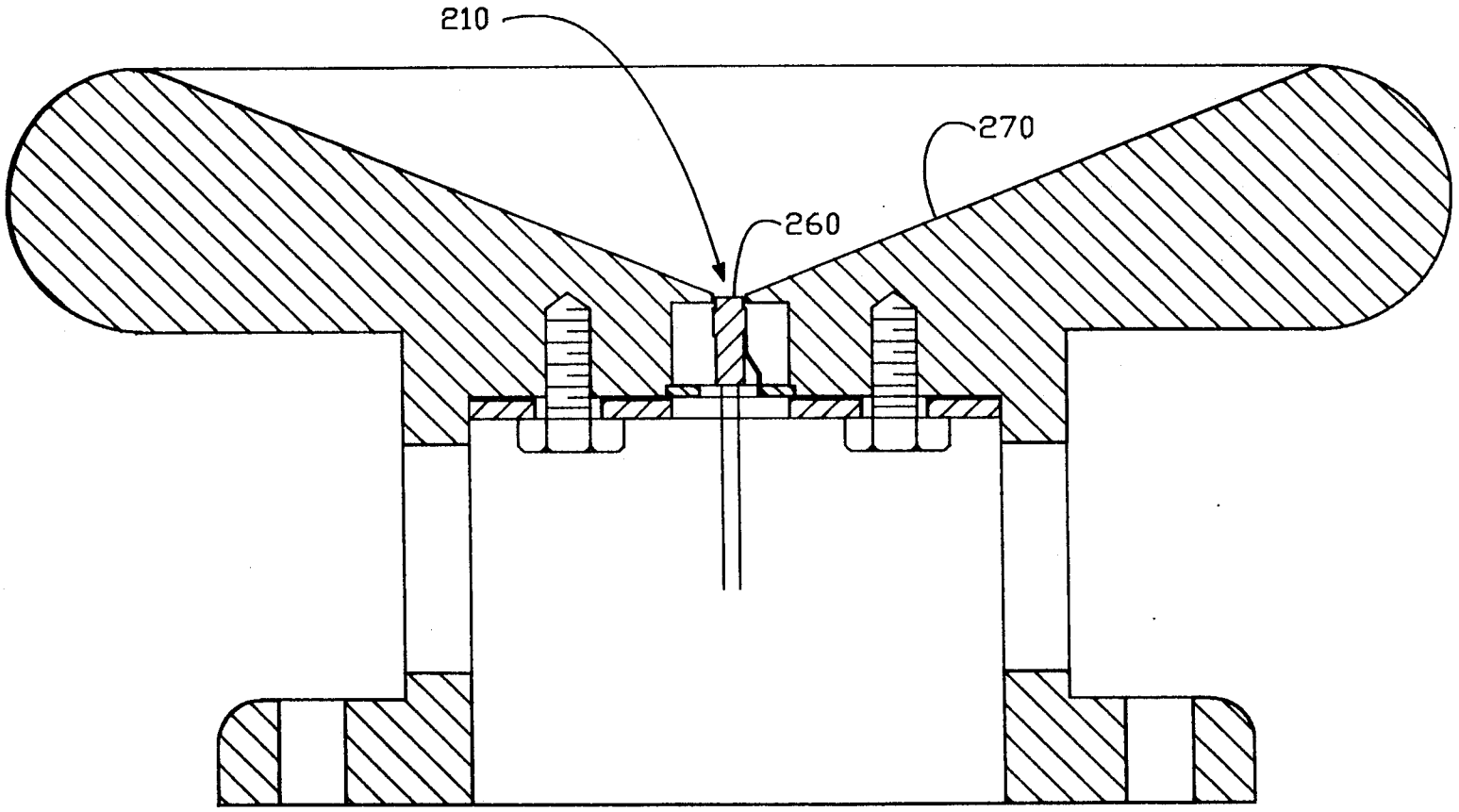
FIG. 10 shows an enlarged detailed view of the cathode system of FIG. 6 with a Pierce electrode shape.

FIG. 10 shows a Pierce electrode 270 extending outwardly from the cathode surface. The cathode surface 260 continues the Pierce shape. The cathode 260 is a very precisely mounted electron emitter. From a variety of different cathode styles and principles we have chosen a proven design of an indirectly heated dispenser cathode. The matrix material of the cathode is sintered tungsten. With barium oxide dispensed in the tungsten matrix. The addition of barium oxide lowers the work function and therefore the operating temperature required for electron emission. The cathode is indirectly heated by the tungsten filament 262. The cathode is electrically insulated, and thermally connected to the heater filament by a pack of alumina powder. To raise the temperature of the emitting surface and to keep the other cathode system surfaces at as low a temperature as possible, part of the cathode system consists of multiple thin radiation reflecting shields surrounding the inactive portions of the system. These shields are constructed from molybdenum/rhenium alloy.

Figure 11:
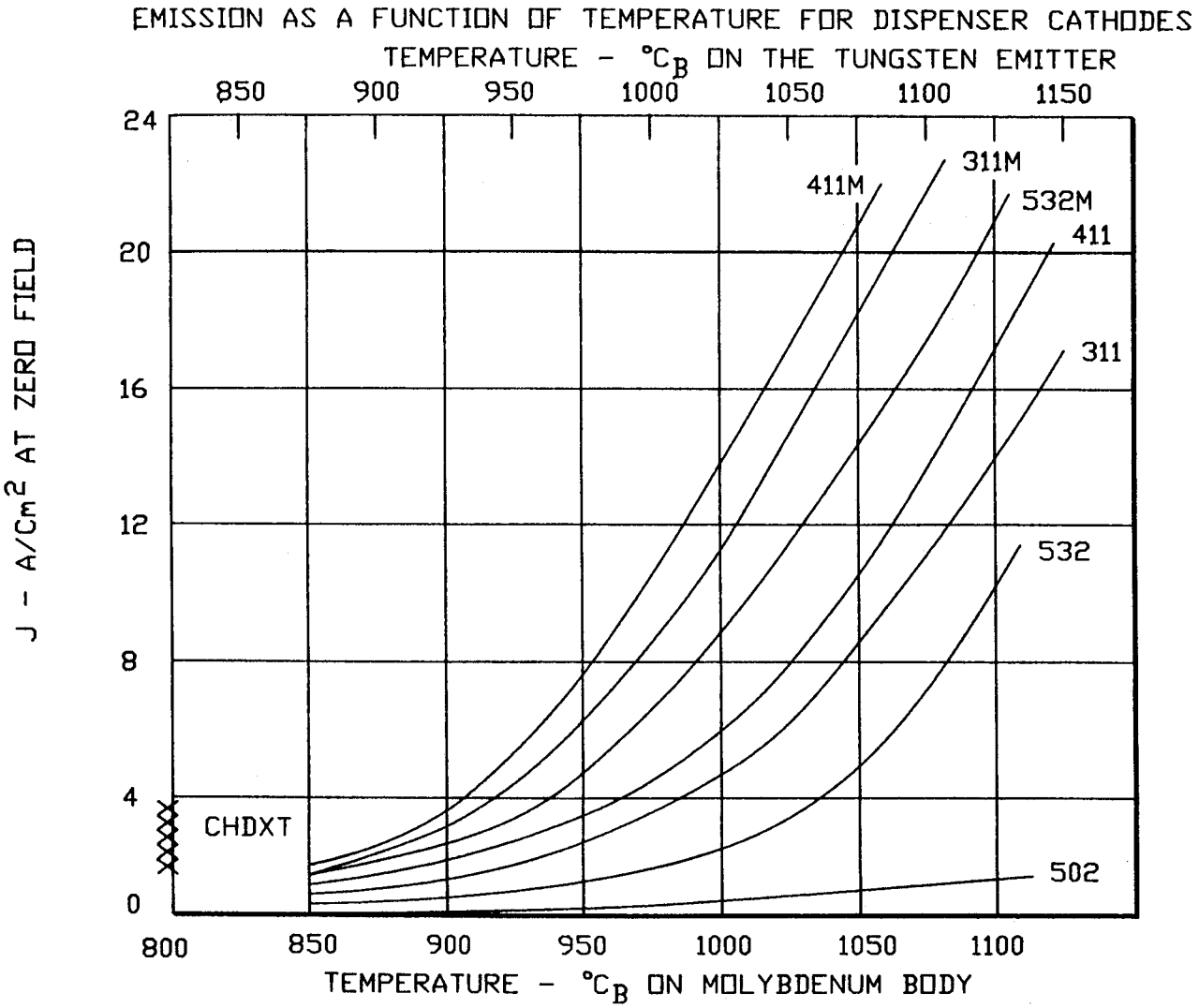
FIG. 11 shows a plot of cathode emission density as a function of emitter temperature where the curve parameter is the type of dopant dispensed in tungsten.

FIG. 11 is a plot of emission density as a function of emitter temperature. The curve parameter is the type of dopant dispensed in tungsten. The emission density is preferably between 1.2 and 4 A/cm$^2$. As seen, such density can be achieved with moderate temperature.

The size of the emitting portion of the cathode is closely related to the smallest focus size achievable. Our cathode emitter spot should be smaller than 1–4 mm$^2$, the emission density required is therefore at least (at 50 mA tube current) 5 to 1.25 A/cm$^2$.

The cathode rotates during operation of the tube, whereas the electron beam is required not to change. The emission conditions thus have to stay perfectly symmetrical. For example the heater has to be wound bi-filar to cancel the magnetic field generated by the heater current. The emitting surface of the cathode conforms to the rotationally symmetric "Pierce" electrode. The general geometry of cathode and electrode is known as a "Pierce design." The electric field distribution established by cathode surface, Pierce electrode, and anode is designed to generate a beam of high energy electrons. The space charge of the electron beam itself is major determinant of the required optimal field distribution.

We have calculated the geometrical parameters for a cathode design using a Pierce diode configuration with an angle of 21 degrees:

Approximate beam current equation $I \approx d^{-1} A\ V^{3/2}$ (saturated), where d is the cathode-anode distance and A is the cathode area.

$d \geqq 1.73$ cm, $A \approx 0.0113$ cm$^2$, $I = 50$ mA, $V = 130{,}000$ Volt

Detailed calculations were made with the program EGUN, written by William Herrmannsfeldt of Stanford University.

An important part of the electron gun design is the tubular anode. The shape of the anode determines the field distribution required for forming a pencil beam of electrons, but it also has an opening so as not to interfere with this beam. The electrical field strength in the bore of the anode and further "downstream" is very small compared to the field between anode and cathode. Virtually all the acceleration of the electrons (to about 60% of the speed of light) takes place before the electrons enter the anode bore. The anode material is molybdenum or copper with an anode bore diameter of 3.5 mm.

Deflection and Focusing

Full electron beam control requires a means for focusing the beam as well as a means for controlling the beam direction. Focusing is traditionally done by making use of the longitudinal magnetic field of a solenoid and the space-charge generated radial velocity component of the electron beam. As a result the diverging electron trajectories are forced back to generate an electron focus. If this focus is formed on a tungsten surface, x-rays are generated relatively efficiently and the source of this radiation has the size and shape of the electron beam focus.

An additional magnetic field, or B-field, (stationary or changing with time) is required to deflect the beam in the desired direction(s). Such a field is commonly established by a separate deflection coil (dipole, x/y coil, deflection yoke, etc.). Often additional coils are used, e.g., a quadrupole correction coil to correct for dipole coil aberrations and to shape the beam spot, and a pre-alignment coil. Choosing this technology would render the tube very bulky and much larger than existing x-ray tubes. It would cause substantial problems of redesigning equipment when such a tube was to replace a traditional x-ray tube.

However, in the case of the present invention, the magnetic field does not vary with time, meaning the magnetic field and coil currents are invariant. We take advantage of the fact that we do not, for example, have to keep a moving beam in focus. We construct an essentially one-parameter (coil current, all others are fixed) electromagnet, called a DELTA magnet. This magnet is very compact, consisting of just two coils wound on two pole pieces. It is a combination magnet, performing three functions with only one coil current. These functions are:

i) sharp focusing in x-direction, required for good image resolution;

ii) elongation of focus in y-direction, required for thermal load distribution on the tungsten target, and iii) bending of the beam path, required for having the electron beam emitted centrally from a rotationally symmetric cathode, but hitting the rotating anode off axis.

Using a crude analogy, this electromagnet acts like an off-axis concave lens in the bend plane and a convex lens in the perpendicular plane so that, when it is hit by a pencil beam of light, it generates, somewhere in its focusing range, a short line, which is offset from the incident beam axis.

Figure 12:
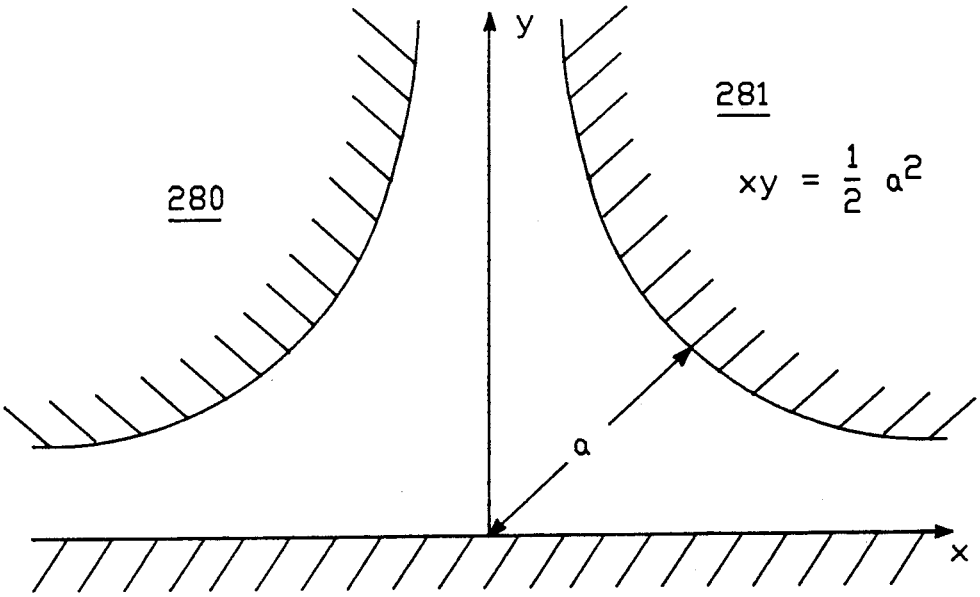
FIG. 12 shows an ideal pole configuration for the magnetic deflection scheme of FIG. 6.

FIG. 12 shows an ideal pole configuration for a Delta Magnet. With high permeability ferromagnetic material, the hyperbolic pole faces together with the flat plate which acts as a magnetic mirror (forming two image pole faces), produce an almost perfect quadrupole magnetic field.

Figure 13:
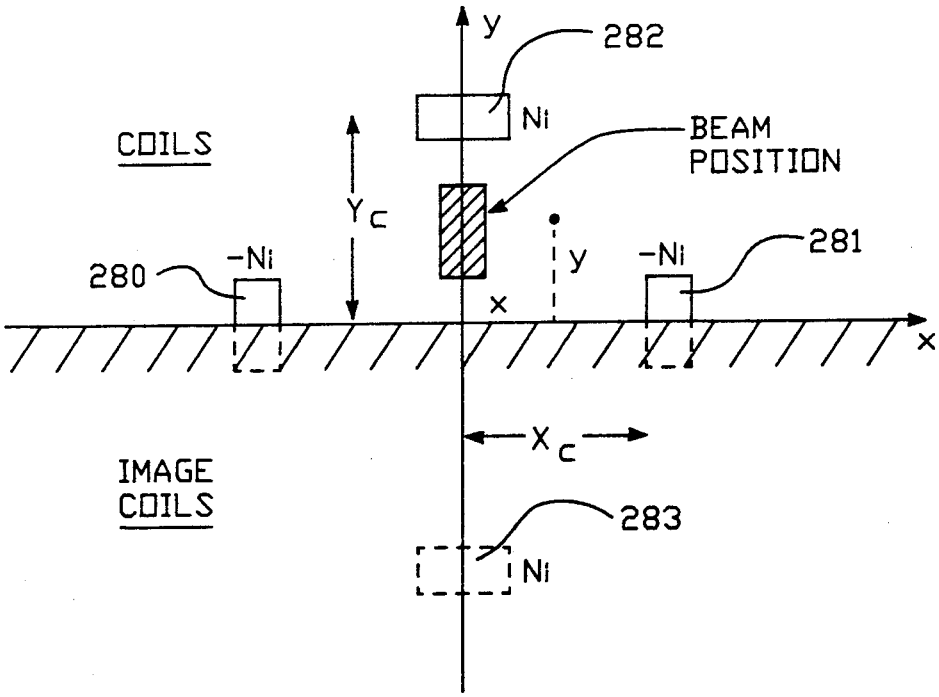
FIG. 13 diagrammatically shows a coil configuration for the magnetic deflection scheme of FIG. 6.

FIG. 13 shows a DELTA Magnet coil configuration. Only the axial parts of the coils are shown. In the absence of the ferromagnetic poles, the coil currents together with their images in the magnetic mirror produce an approximate quadrupole field. The distances X and Y are chosen to produce an acceptably constant field gradient at the electron beam position.

We have calculated the magnet field for the pole geometry in FIG. 12 and the coil arrangement in FIG. 13. Then the coil contributions to the field gradient have been expressed as constants (for a given beam location) plus components ($dg_x$ and $dg_y$) which vary over the beam cross-section.

We have calculated extreme values of the $dg_x$'s and $dg_y$'s for the following parameters:

| | |
|---|---|
| pole piece to center distance: | a = 5 cm |
| beam position: | y = 3 cm +/− 0.2 cm x = +/− 0.1 cm |
| coil positions: | $y_c$ = 8 cm |
| "symmetrical" | $x_c$ = 8 cm |

-continued

| | |
|---|---|
| "compact" | $x_c$ = 5 cm |
| "min. nonuniformity" | $x_c$ = 5.85 cm |

| x (cm) | $dg_x$ | $dg_y$ | coil contribution (%) |
|---|---|---|---|
| 8.00 | 1.06 | 1.23 | 21.0 |
| 5.85 | −0.08 | −0.08 | 23.1 |
| 5.00 | −0.80 | −0.83 | 23.7 |

Result: all these field gradient errors easily satisfy the uniformity requirement.

It is interesting to note that the more compact design (x=5) actually produces a more uniform gradient at the beam position than the symmetrical design (x=y=8).

Figure 14A:
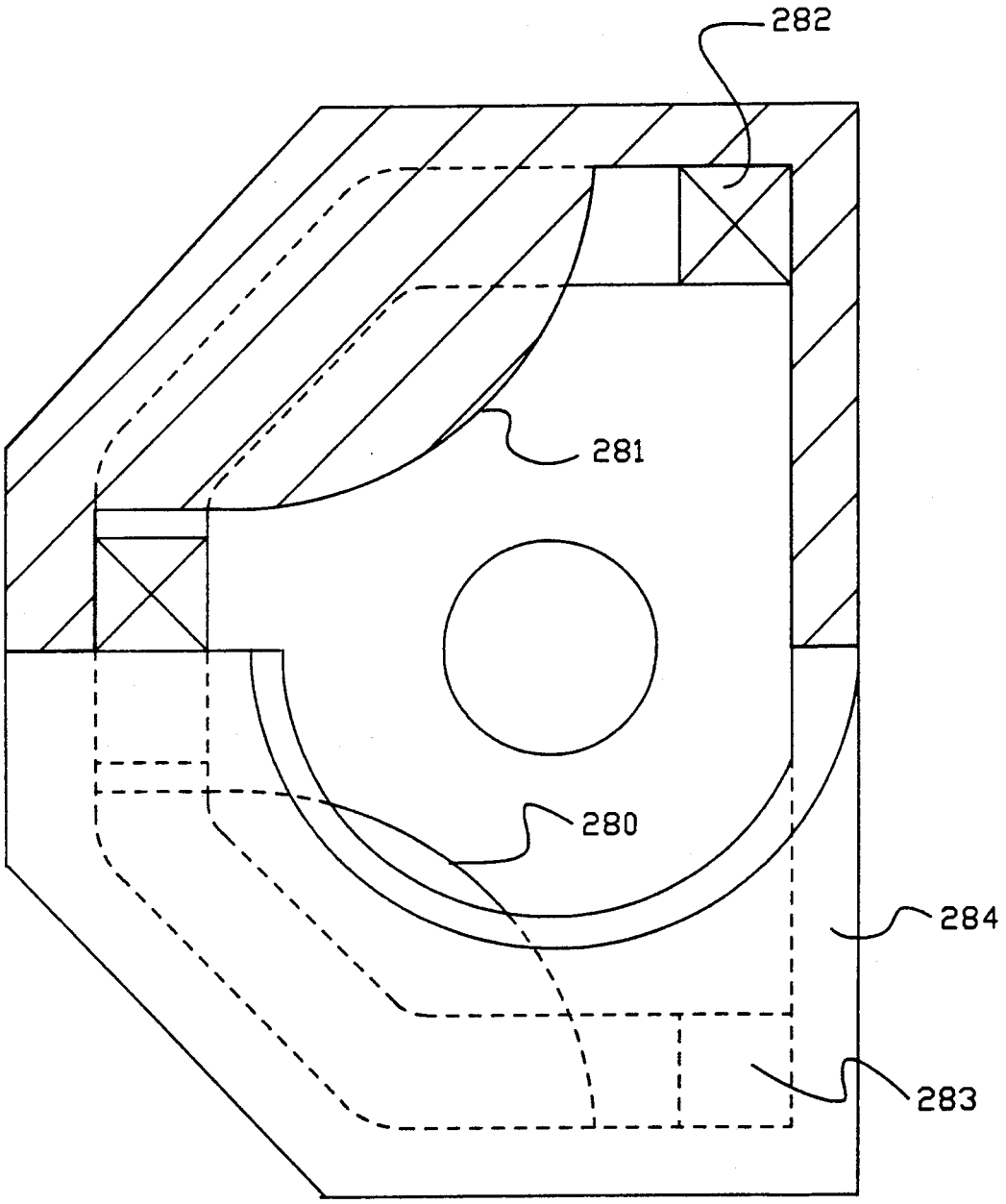
FIG. 14A is an end view of a deflection coil assembly.
Figure 14C:
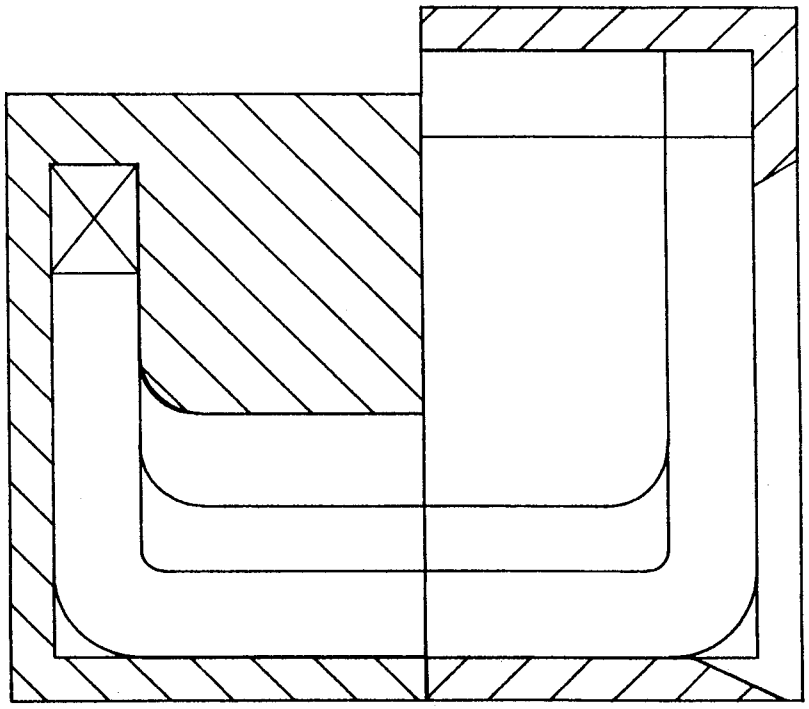
FIG. 14C is an elevational, sectional view of a deflection coil assembly. system for the embodiment of FIG. 6.
Figure 14B:
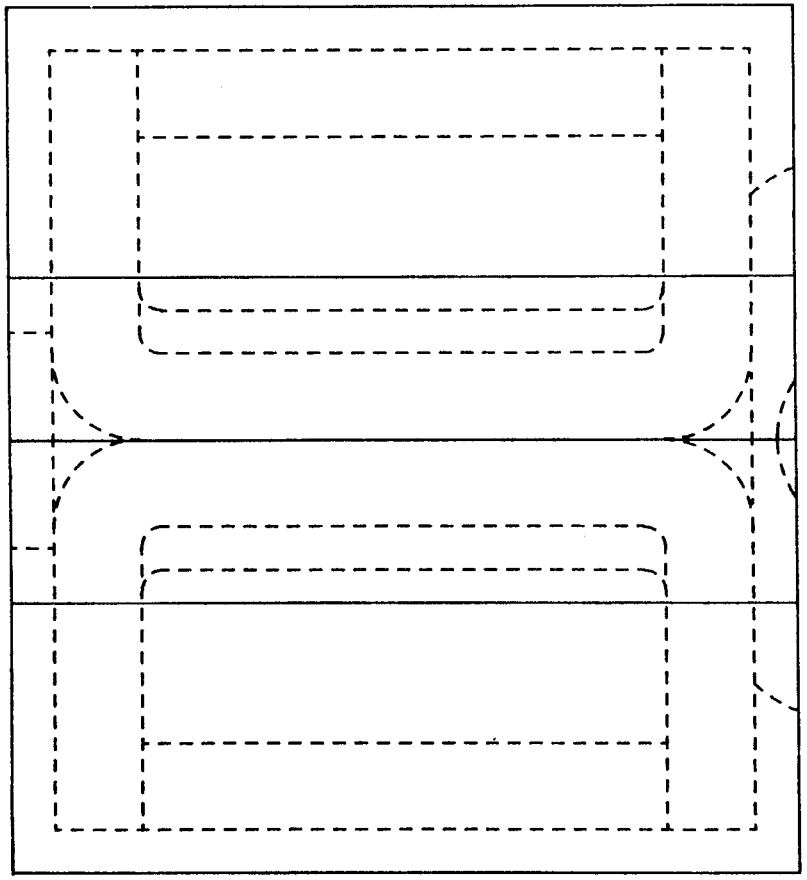
FIG. 14B is a top view of a deflection coil assembly.

FIGS. 14A , 14B, and 14C show various sectional views of the DELTA magnet pole pieces 280, 281 and coils 282, 283.

The beam focusing requirement in the x-ray tube is that the electron beam spot should be elongated in the radial direction to avoid damaging the target (anode) and focused to as small a dimension as possible in the transverse direction to provide a small x-ray spot. A single quadrupole field magnet which diverges the beam in one plane and converges it in a transverse plane is the obvious choice. The beam may also be deflected by arranging that the incident beam is parallel to but not coincident with the quadrupole axis. For a given focusing power, the angle of deflection may be chosen independently by varying the beam offset.

With such an arrangement, only half of the quadrupole field is used. It is permitted therefore to omit the lower half of the magnet (and 2 of the 4 coils) and replace it with planar ferromagnetic "mirror" plate 284. This does not alter the magnetic field distribution in the remaining part of the magnet since all field lines meet this mirror plate normally. Thus we have the "delta" magnet configuration which is really a half quadrupole.

The longest configuration with the smallest effective focal spot is limited by the excessive height (y-dimension) of the electron beam spot.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed:

1. An x-ray tube, comprising:

an envelope for containing a vacuum;

target means forming part of said envelope for emitting x-rays;

an electron-beam accelerator assembly including:

an indirectly heated cathode assembly having a cathode for emitting electrons;

a shaped rotationally symmetric electrode surrounding said cathode;

a primary shaped anode with a central bore spaced from said cathode for accelerating the electrons emitted by said cathode, said shaped electrode and shaped anode providing focusing fields which focus the electron beam to form a beam waist at the center of said bore;

means external of said envelope for focusing said electron beam leaving the anode on said target means;

support means external to said envelope for supporting said envelope for rotational movement; and means external of said envelope for deflecting said electron beam along a selected path as said envelope rotates such that said electron beam strikes selected portions of said target means as it rotates.

2. An x-ray tube as in claim 1 wherein said means for deflecting includes two magnetic coils and a ferromagnetic mirror plate arranged to function as a single quadrupole electromagnet, which has its axis parallel to and offset from the electron beam and which elongates the electron beam in a radial direction.

3. An x-ray tube as in claim 1 including ion clearing electrodes disposed between said primary anode and said target to sweep away from said electron beam positively charged residual gas ions.

4. An x-ray tube as in claim 1 in which said support means external of the envelope comprises a housing and bearings between said housing and envelope.

5. An x-ray tube as in claim 4 in which said housing envelope and bearing define a chamber for containing insulating fluid.

6. An x-ray tube as in claim 1 in which said target is fluid cooled.

7. An x-ray tube as in claim 1 wherein said means for deflecting includes two magnetic coils and a ferromagnetic mirror plate arranged to function as a single quadrupole electromagnet, which has its axis parallel to and offset from the electron beam and which elongates the electron beam in a radial direction.

8. An x-ray tube as in claim 4 including ion clearing electrodes disposed between said primary anode and said target to sweep away from said electron beam positively charged residual gas ions.

9. An x-ray tube, comprising an envelope for containing a vacuum;

target means forming part of said envelope for emitting x-rays;

an electron-beam accelerator assembly including:

an indirectly heated cathode assembly for emitting an electron beam, wherein said cathode means includes an electron-emitting region mounted at the center of a rotationally symmetric Pierce-cathode configuration;

a primary anode having formed therein an aperture through which the electron beam is accelerated by said anode, said anode and Pierce-cathode forming a beam waist at said aperture;

means for focusing said electron beam on said target means;

support means external to said envelope for supporting said envelope for rotational movement; and means external of said envelope for deflecting said electron beam along a selected path as said envelope rotates such that said electron beam strikes selected portions of said target means as it rotates.

* * * * *